US006553624B1

(12) United States Patent
Lin

(10) Patent No.: US 6,553,624 B1
(45) Date of Patent: Apr. 29, 2003

(54) HINGE DEVICE FOR CABINETS WITH PREVENTION OF AUTOMATIC OPENING OF DOORS

(76) Inventor: Tsung-Lung Lin, No. 146, Min Chuan Road, Ta Hu Village, Hu Nei Hsiang, Kaohsiung Hsien (TW)

( * ) Notice: Subject to any disclaimer, the term of this patent is extended or adjusted under 35 U.S.C. 154(b) by 0 days.

(21) Appl. No.: 09/134,819

(22) Filed: Aug. 17, 1998

(51) Int. Cl.[7] ..... E05D 11/10
(52) U.S. Cl. ..... 16/335; 16/319; 16/327
(58) Field of Search ..... 16/335, 334, 319, 16/326, 327, 331, 332, 341, 352

(56) References Cited

U.S. PATENT DOCUMENTS

| | | | | | |
|---|---|---|---|---|---|
| 4,570,289 | A | * | 2/1986 | Consolati | 16/332 |
| 4,596,062 | A | * | 6/1986 | Rock | 16/332 |
| 4,987,640 | A | * | 1/1991 | Lin | 16/327 |
| 5,058,238 | A | * | 10/1991 | Lautenschlager | 16/341 |

OTHER PUBLICATIONS

Taiwan Utility Model Publication No. 250868, published Jul. 1, 1995.

* cited by examiner

*Primary Examiner*—Chuck Y. Mah

(74) *Attorney, Agent, or Firm*—Stevens, Davis, Miller & Mosher, LLP

(57) ABSTRACT

A hinge device includes a base plate securely mounted to a door of a cabinet and an arm securely mounted to a side panel of the cabinet. A first pivotal member includes a first end pivotally connected to the base plate and a second end pivotally connected to the arm by a pivotal pin. A second pivotal member includes a first end pivotally connected to the base plate and a second end pivotally connected to the arm. An elastic member is mounted around the pivotal pin and includes a first end attached to the arm and a second end attached to the second pivotal member. A control seat is securely mounted to the arm and includes a compartment for movably receiving a restraining member therein. The second end of the elastic member is extended into the compartment. When the cabinet is in a stable status, the restraining member does not engage with the second end of the elastic member and thus allows opening of the door. When the cabinet leans forwardly, the restraining member moves to a position to engage with the second end of the elastic member and thus prevents from opening of the door of the cabinet.

4 Claims, 5 Drawing Sheets

HINGE DEVICE FOR CABINETS WITH PREVENTION OF AUTOMATIC OPENING OF DOORS

BACKGROUND OF THE INVENTION

1. Field of the Invention

The present invention relates to a hinge device for cabinets that may prevent from automatic opening of doors of leaning cabinets to thereby reduce damage to the articles, especially fragile articles, stored in the cabinets.

2. Description of the Related Art

Cabinets are generally equipped with hinge devices to allow opening of doors thereof. An example of hinge devices for cabinets is disclosed in Taiwan Utility Model Publication No. 250868. Nevertheless, when the cabinets lean forwardly (e.g., when subjected to an external force), the doors of the cabinets might open automatically. As a result, articles, especially fragile articles, stored in the cabinets will fall to the floor and thus be damaged. In addition, the sudden automatic opening of the cabinet doors and falling of the fragile articles may cause injury to people. The present invention is intended to provide an improved hinge device to solve this problem.

SUMMARY OF THE INVENTION

It is a primary object of the present invention to provide an improved hinge device for cabinets that may prevent from automatic opening of the doors of the cabinets when the cabinets lean forwardly, thereby reducing damage to the articles in the cabinets and preventing from injury to people.

A hinge device in accordance with the present invention comprises a base plate securely mounted to a door of a cabinet and an arm securely mounted to a side panel of the cabinet. A first pivotal member includes a first end pivotally connected to the base plate and a second end pivotally connected to the arm by a pivotal pin. A second pivotal member includes a first end pivotally connected to the base plate and a second end pivotally connected to the arm. An elastic member is mounted around the pivotal pin and includes a first end attached to the arm and a second end attached to the second pivotal member. A control seat is securely mounted to the arm and includes a compartment for movably receiving a restraining member therein. The second end of the elastic member is extended into the compartment.

When the cabinet is in a stable status, the restraining member does not engage with the second end of the elastic member and thus allows pivotal movements of the first pivotal member and the second pivotal member. When the cabinet leans forwardly, the restraining member moves to a position to engage with the second end of the elastic member and thus prevents from pivotal movement of the second pivotal member, thereby preventing from pivotal movement of the door relative to the side panel of the cabinet. Accordingly, damage to fragile articles in the cabinet can be reduced and injury to people can be avoided.

The arm may include a pair of protrusions, and the control seat may include two lateral engaging grooves for securely receiving the protrusions.

In a preferred embodiment of the invention, the movable restraining member is a ball. The control seat may include a slot through which the second end of the elastic member is extended into the compartment.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
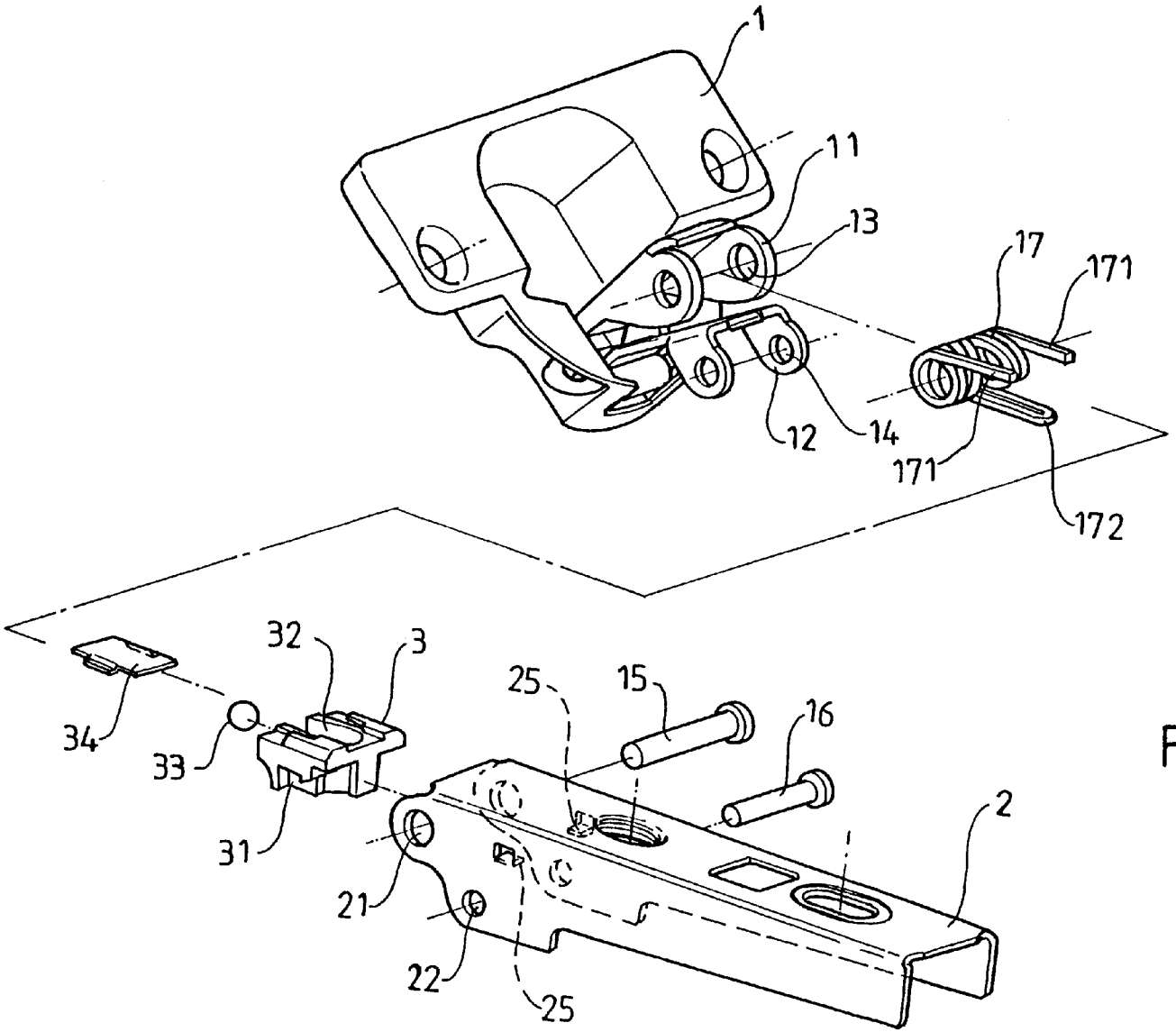
FIG. 1 is an exploded perspective view of a hinge device for cabinets in accordance with the present invention.
Figure 2:
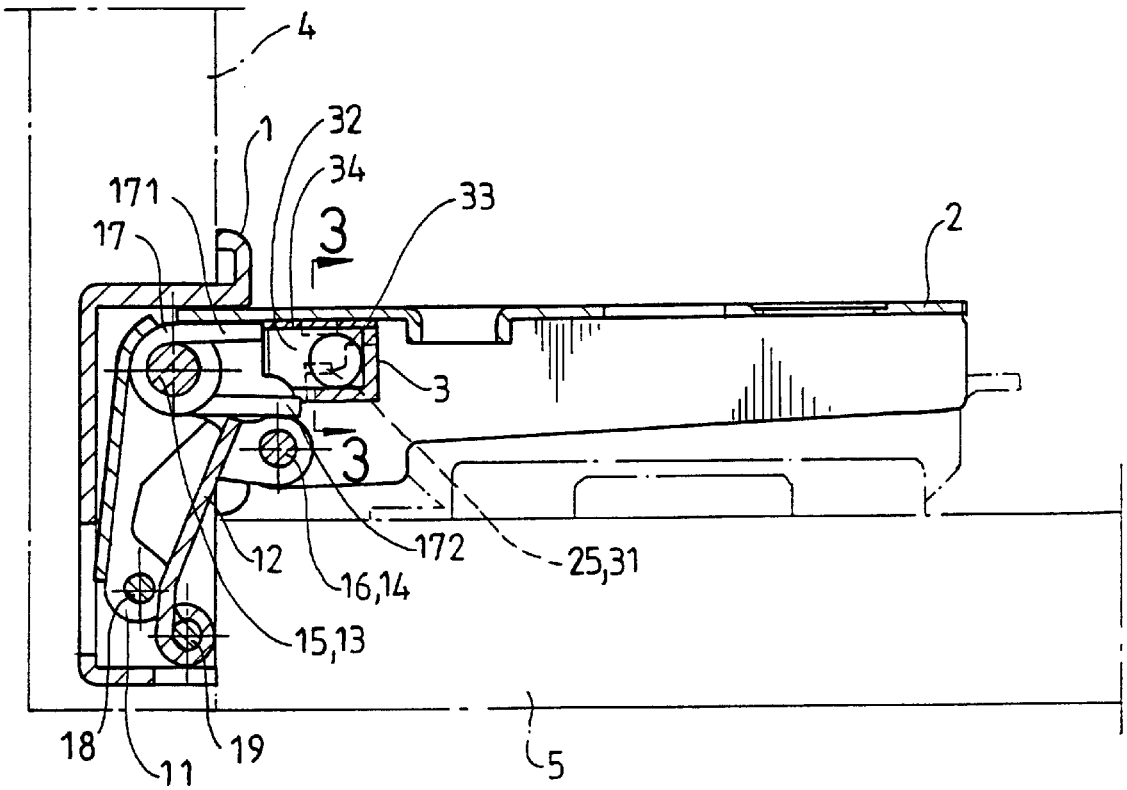
FIG. 2 is a schematic sectional view of the hinge device, wherein a side panel and a door, of a cabinet to which the hinge device is mounted, are illustrated by phantom lines for clarity.

Referring to the drawings and initially to FIGS. 1 and 2, a hinge device for cabinets in accordance with the present invention generally includes a base plate 1 securely mounted to an inner side of a door plate 4 (FIG. 2) of a cabinet (not shown in detail) and an arm 2 securely mounted to an inner side of a side panel 5 (FIG. 2) of the cabinet. A first pivotal member 11 includes a first end pivotally connected to the base plate 1 at 18 (FIG. 2) and a second end pivotally connected to the arm 2. A second pivotal member 12 includes a first end pivotally connected to the base plate 1 at 19 (FIG. 2) and a second end pivotally connected to the arm 2. In this embodiment, the first pivotal member 11 includes spaced lugs (not labeled) having aligned holes 13 for pivotally receiving a pivotal pin 15, and an elastic member 17 is mounted around the pivotal pin 15 and includes a first end 171 attached to an inner wall of the arm 2 that faces the side panel and a second end 172 attached to the second pivotal member 12. The second pivotal member 12 includes spaced lugs (not labeled) having aligned holes 14 for pivotally receiving a pivotal pin 16.

The arm 2 includes aligned holes 21 through which the pivotal pin 15 is extended and aligned holes 22 through which the pivotal pin 16 is extended. The arm 2 further includes a pair of protrusions 25 formed on the inner wall for engaging with two lateral engaging grooves 31 of a control seat 3 to thereby securely mount the control seat 3 to the arm 2. The control seat 3 includes a compartment 32 for receiving a movable restraining member (e.g., a ball 33) therein, and a lid 34 is provided to retain the ball 33 in the compartment 32. It is noted that the second end 172 of the elastic member 17 is extended into the compartment 32 via a notch or slot (not labeled) defined in the control seat 3.

Figure 3:
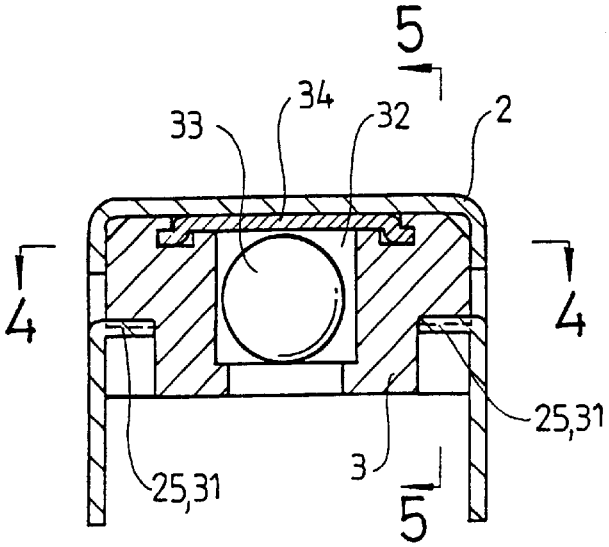
FIG. 3 is a sectional view taken along line 3—3 in FIG. 2.
Figure 4:
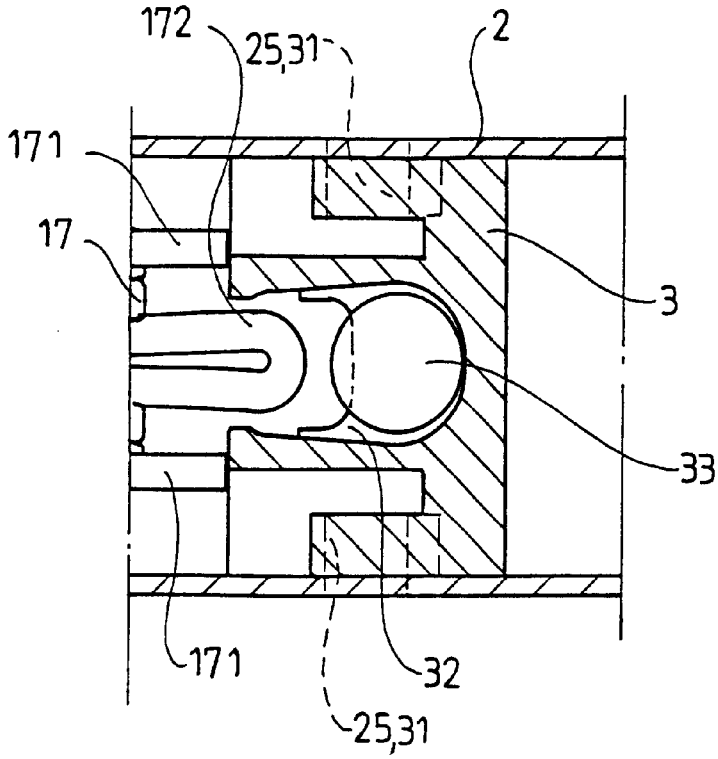
FIG. 4 is a sectional view taken along line 4—4 in FIG. 3.
Figure 5:
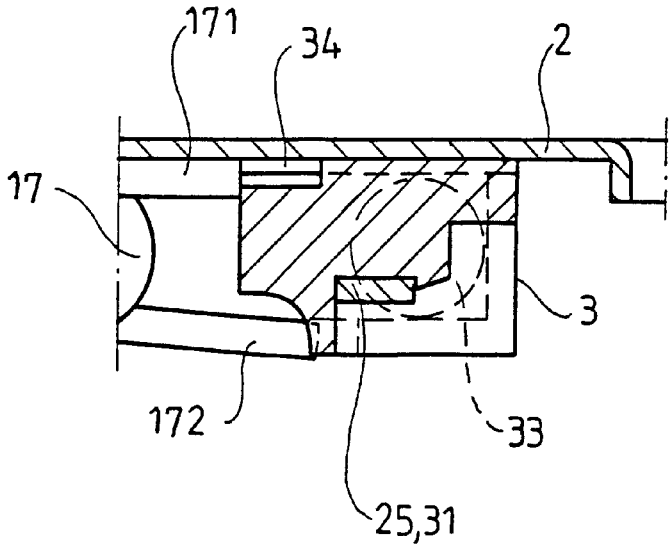
FIG. 5 is a sectional view taken along line 5—5 in FIG. 3.
Figure 6:
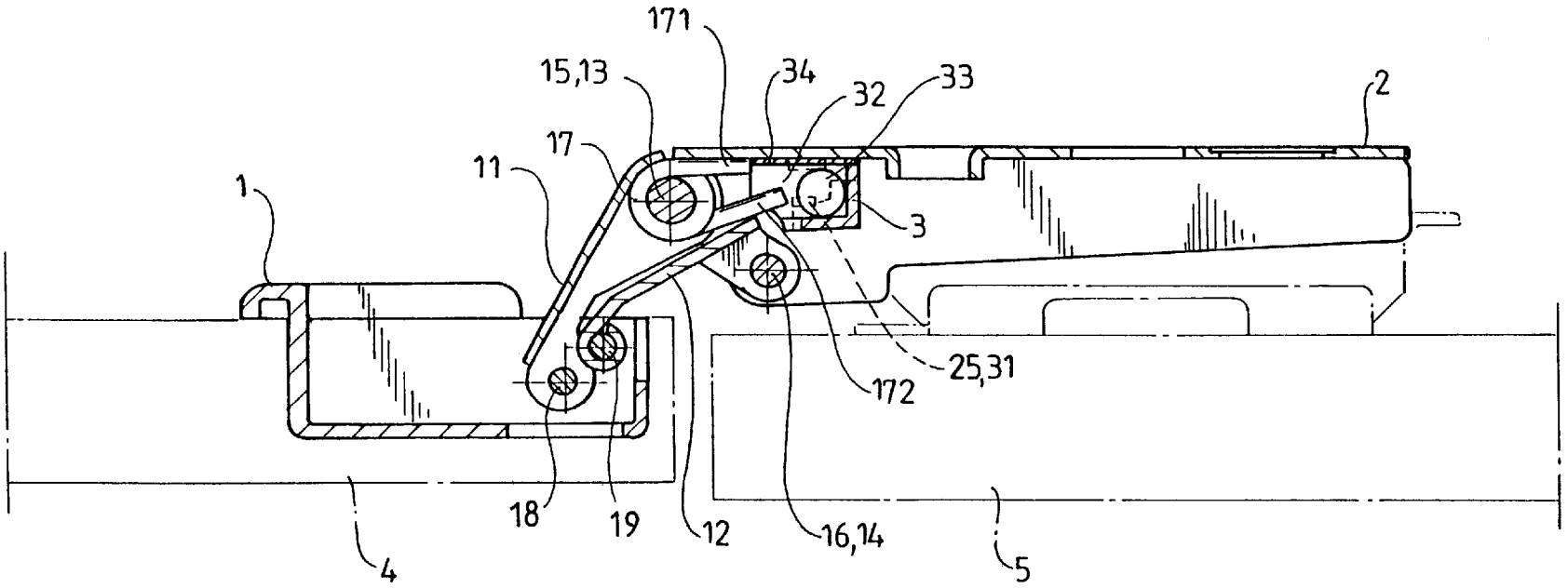
FIG. 6 is a sectional view illustrating normal operation of the hinge device.
Figure 7:
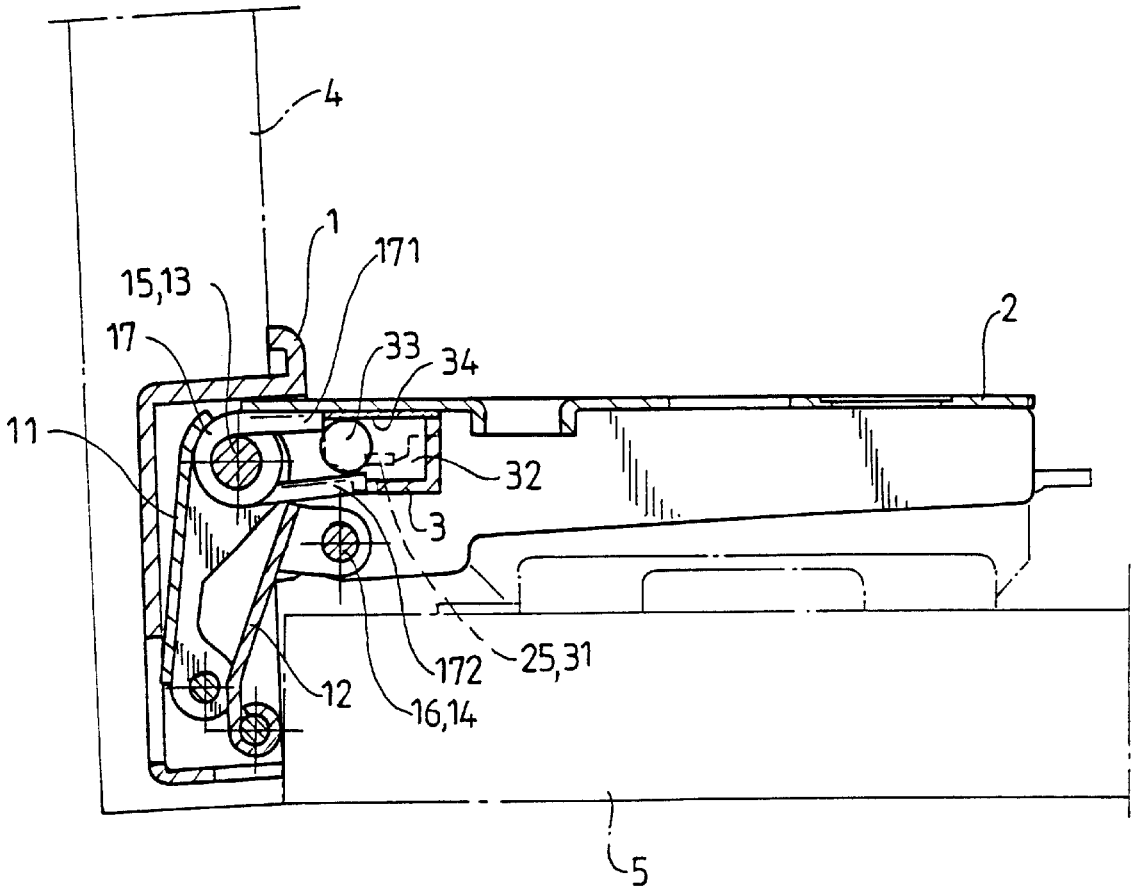
FIG. 7 is a sectional view illustrating locking function of the hinge device when the cabinet leans forwardly.

When the cabinet is in a stable status, the ball 33 in the compartment 32 of the control seat 3 does not contact with the second end 172 of the elastic member 17, as shown in FIGS. 3 to 5. Thus, the door 4 can be opened under normal operation, as shown in FIG. 6). Nevertheless, when the cabinet leans forwardly, the ball 33 rolls toward the second end 172 of the elastic member 17 and thus cause an obstacle to pivotal movement of the second pivotal member 12, as the second end 172 of the elastic member 17 now engages with the ball 33 and thus cannot be moved, best shown in FIG. 7.

As a result, automatic opening of the door 4 due to forward leaning of the cabinet is prevented. Accordingly, damage to fragile articles in the cabinet can be reduced and injury to people can be avoided.

Although the invention has been explained in relation to its preferred embodiment, it is to be understood that many other possible modifications and variations can be made without departing from the spirit and scope of the invention as hereinafter claimed.

What is claimed is:

1. A hinge device for cabinets, comprising:

a base plate adapted to be securely mounted to a door of a cabinet, an arm adapted to be securely mounted to a side panel of the cabinet, a first pivotal member including a first end pivotally connected to the base plate and a second end pivotally connected to the arm by a pivotal pin, a second pivotal member including a first end pivotally connected to the base plate and a second end pivotally connected to the arm, an elastic member mounted around the pivotal pin and including a first end attached to the arm and a second end attached to the second pivotal member, and a control seat securely mounted to the arm and including a compartment therein, a restraining member being movably received in the compartment, and the second end of the elastic member being extended into the compartment, whereby when the cabinet is in a stable status, the restraining member does not engage with the second end of the elastic member and thus allows pivotal movements of the first pivotal member and the second pivotal member, and when the cabinet leans forwardly, the restraining member moves to a position to engage with the second end of the elastic member and thus prevents from pivotal movement of the second pivotal member, thereby preventing from pivotal movement of the door relative to the side panel of the cabinet.

2. The hinge device as claimed in claim 1, wherein the arm includes a pair of protrusions, and the control seat includes two lateral engaging grooves for securely receiving the protrusions.

3. The hinge device as claimed in claim 1, wherein the movable restraining member is a ball.

4. The hinge device as claimed in claim 1, wherein the control seat includes a slot through which the second end of the elastic member is extended into the compartment.

* * * * *